US007793528B2

(12) United States Patent
Maples

(10) Patent No.: US 7,793,528 B2
(45) Date of Patent: Sep. 14, 2010

(54) KEY-OPERATED MECHANICAL LOCK

(76) Inventor: Stephen S. Maples, 2250 Baldwin Hwy., Adrian, MI (US) 49221

( * ) Notice: Subject to any disclaimer, the term of this patent is extended or adjusted under 35 U.S.C. 154(b) by 425 days.

(21) Appl. No.: 11/879,067

(22) Filed: Jul. 16, 2007

(65) Prior Publication Data

US 2008/0190153 A1 Aug. 14, 2008

Related U.S. Application Data

(60) Provisional application No. 60/900,860, filed on Feb. 12, 2007.

(51) Int. Cl.
*E05B 21/00* (2006.01)

(52) U.S. Cl. ..... 70/352; 70/313; 70/348; 70/387; 70/DIG. 9

(58) Field of Classification Search ..... 70/313, 70/344, 345, 347–351, 353–355, 387, DIG. 9, 70/DIG. 2, DIG. 21, DIG. 25, DIG. 29, DIG. 80, 70/352, DIG. 22
See application file for complete search history.

(56) References Cited

U.S. PATENT DOCUMENTS

| | | | | | |
|---|---|---|---|---|---|
| 11,949 | A | * | 11/1854 | Fergusson | 37/440 |
| 123,558 | A | * | 2/1872 | Dopp | 70/437 |
| 227,301 | A | * | 5/1880 | Reinhart | 70/345 |
| 663,876 | A | * | 12/1900 | Fergusson | 70/347 |
| 664,674 | A | * | 12/1900 | Petersen | 70/134 |
| 665,232 | A | * | 1/1901 | Kossov et al. | 70/387 |
| 774,823 | A | * | 11/1904 | Birkedal | 70/134 |
| 834,918 | A | | 11/1906 | Lindgren | |
| 1,050,692 | A | | 1/1913 | Resch | |
| 1,095,431 | A | | 5/1914 | Sprague | |
| 1,193,412 | A | * | 8/1916 | Nelson | 70/345 |
| 1,596,313 | A | | 8/1926 | Schmidt | |
| 1,647,354 | A | * | 11/1927 | Helmuth | 70/134 |
| 2,070,619 | A | * | 2/1937 | Price | 70/353 |
| 2,440,433 | A | | 4/1948 | Best | |
| 2,595,267 | A | * | 5/1952 | Julliard | 70/387 |
| 2,910,860 | A | | 11/1959 | Camba | |
| 3,167,944 | A | | 2/1965 | Pickering | |
| 3,412,587 | A | * | 11/1968 | Sanowskis | 70/313 |
| 3,780,549 | A | | 12/1973 | Schlage | |
| 3,969,596 | A | * | 7/1976 | Siegel | 200/43.09 |

(Continued)

FOREIGN PATENT DOCUMENTS

| | | |
|---|---|---|
| CH | 132 552 A | 4/1929 |

(Continued)

*Primary Examiner*—Lloyd A Gall
(74) *Attorney, Agent, or Firm*—Young, Basile, Hanlon & MacFarlene, P.C.

(57) ABSTRACT

A lock operated by a corresponding key. The lock has a housing, and a keyway is formed in the housing along a keyway axis for receiving the corresponding key therein. A latch is moveable with respect to the housing between a first position, wherein the lock is secured, and a second position, wherein the lock is not secured. A permutation surface is formed on the latch, and a plurality of intermediaries are disposed within the housing. Each intermediary has a first portion engageable with the permutation surface of the latch and a second portion engageable with the corresponding key, wherein insertion of the corresponding key into the keyway selectively engages the intermediaries with the permutation surface in a predetermined sequence, thereby moving the latch from the first position to the second position.

20 Claims, 13 Drawing Sheets

U.S. PATENT DOCUMENTS

| | | | | |
|---|---|---|---|---|
| 4,007,615 | A | 2/1977 | Nossum | |
| 4,014,194 | A * | 3/1977 | Hartman | 70/313 |
| 4,109,495 | A | 8/1978 | Roberts | |
| 4,196,603 | A * | 4/1980 | Malacheski et al. | 70/313 |
| 4,429,555 | A | 2/1984 | Salsbury | |
| 4,790,160 | A * | 12/1988 | Chateau | 70/351 |
| 5,355,701 | A * | 10/1994 | Tobias | 70/394 |
| 6,477,875 | B2 | 11/2002 | Field et al. | |
| 6,578,396 | B2 | 6/2003 | Field et al. | |
| 6,595,032 | B2 * | 7/2003 | Lin | 70/352 |
| 6,622,538 | B2 | 9/2003 | Prunbauer et al. | |
| 6,945,082 | B2 | 9/2005 | Field et al. | |
| 2002/0134122 | A1 | 9/2002 | Li | |
| 2006/0225471 | A1 | 10/2006 | Fernandez | |

FOREIGN PATENT DOCUMENTS

| | | | |
|---|---|---|---|
| GB | 1 201 622 | A | 8/1970 |
| WO | WO 96/02720 | A | 2/1996 |

* cited by examiner

KEY-OPERATED MECHANICAL LOCK

CROSS-REFERENCE TO RELATED APPLICATIONS

This application claims the benefit of U.S. Provisional Application No. 60/900,860, filed Feb. 12, 2007.

FIELD OF THE INVENTION

The present invention relates to the field of mechanical key operated locks, and more particularly, the present invention relates to a lock operated by manipulating a plurality of intermediary elements in a predetermined sequence.

BACKGROUND OF THE INVENTION

Key-operated mechanical locks are well known and used for a variety of purposes, to secure a wide variety of objects. By far, the most common design is the pin-tumbler lock, which has proven popular on account of simple construction and ease of operation.

Conventional pin-tumbler locks have split-pins, wherein the pins restrain a first portion of the lock, commonly referred to as a cylinder, against rotation with respect to a second portion of the lock, commonly referred to as a housing, until the pins are moved in a position where the two halves of each split pin straddle a shear line, thus allowing rotation of the cylinder with respect to the housing. However, the vast majority of pin-tumbler locks are susceptible to lock-picking by manipulation of their pins to the shear line by objects other than the key which corresponds to the lock. Over the years, numerous designs have been proposed to address this problem with varying degrees of success. However, the vast majority of these devices are ineffective.

It would thus be desirable to have a key-operated mechanical lock that is of simple construction, easy to use, and which addresses the problems attendant to the prior art.

SUMMARY OF THE INVENTION

The present invention relates to a mechanical lock that is operated by a corresponding key. The lock has a housing with a keyway formed therein along a keyway axis for receiving the corresponding key therein. The latch is moveable with respect to the housing between a first position, wherein the lock is secured, and a second position, wherein the lock is not secured. A permutation surface is formed on the latch, and a plurality of intermediaries are disposed within the housing. Each intermediary has a first portion engageable with the permutation surface of the latch and a second portion engageable with the corresponding key, wherein insertion of the corresponding key into the keyway selectively engages the intermediaries with the permutation surface in a predetermined sequence, thereby moving the latch from the first position to the second position.

A plurality of camming surfaces are formed on the permutation surface of the latch, and engagement of one of the intermediaries with one of the camming surfaces is operable to move the latch. Furthermore, engagement of the intermediaries with the latch may result in motion of the latch substantially parallel to the keyway axis, substantially perpendicular to the keyway axis, or in rotation with respect to the keyway axis. Additionally, the latch may move along a latch axis. The latch axis may extend substantially parallel to the keyway axis, or the latch axis may extend substantially perpendicular to the keyway axis.

The plurality of intermediaries may move along a line of action that is substantially perpendicular to the keyway axis. Furthermore, the plurality of intermediaries may move along a line of action that is substantially perpendicular to the latch.

BRIEF DESCRIPTION OF THE DRAWINGS

The description herein makes reference to the accompanying drawings wherein like referenced numerals refer to like parts throughout several views and wherein.

DESCRIPTION OF THE PREFERRED EMBODIMENT

Figure 1:
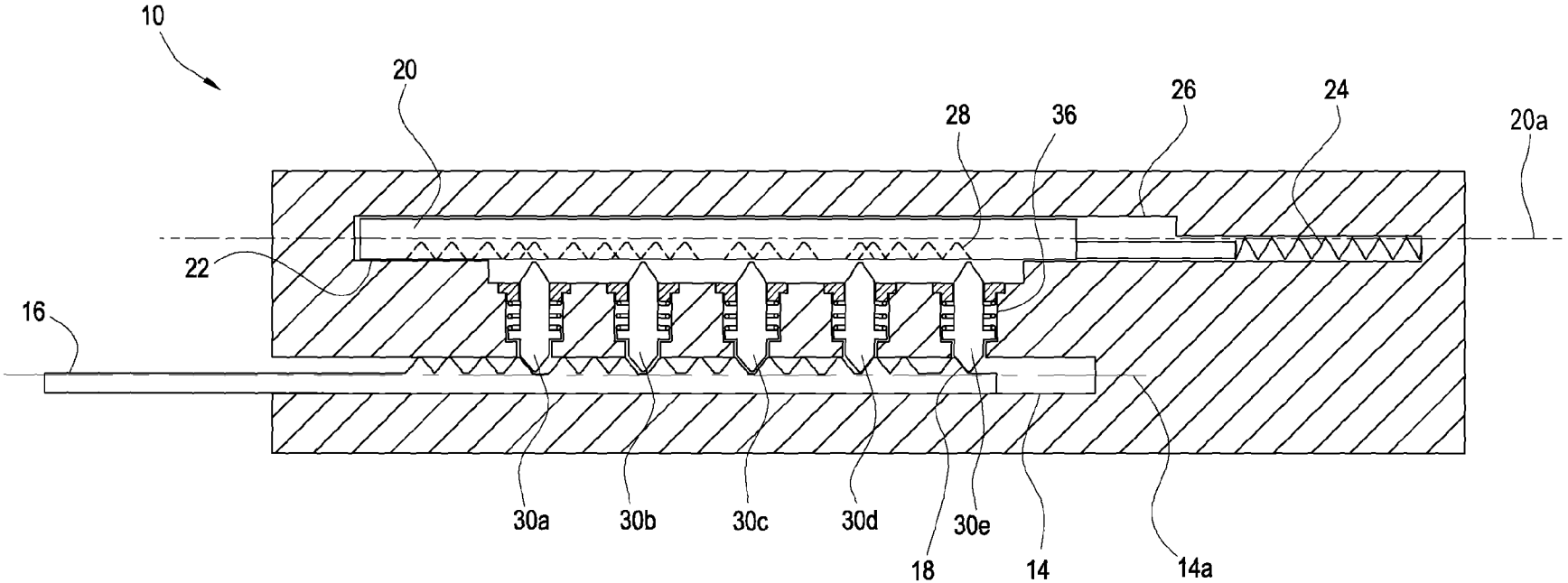
FIG. 1 is a sectional view of a first embodiment of the present invention.

Referring now to the drawings, wherein like numerals indicate like or corresponding parts throughout the several views, the present invention will be seen to most generally comprise a latch having a permutation surface formed thereon and a plurality of intermediary elements that are selectively engageable with the permutation surface of the latch. The latch is moveable between a first position, wherein the lock is secured, and a second position, wherein the lock is not secured. Engagement of the intermediaries with the permutation surface of the latch in a predetermined sequence is operable to move the latch from the locked position to the unlocked position. Any of the embodiments discussed herein may be incorporated into conventional locking mechanisms, such as door locks, padlocks, automotive ignition locks, and the like, wherein the latch may serve as an end effector or may be operatively related to an end effector either directly or indirectly.

FIG. 1 shows a key-operated mechanical lock 10 according to a first embodiment of the present invention. The main portions of the lock 10 are a housing 12, a latch 20, and a plurality of intermediary operators 30. The lock 10 is operated by a key 16 having a plurality of bits 18 formed on at least one surface thereof for engagement with the plurality of intermediary operators 30. The bits 18 of the key 16 are formed corresponding to the geometry of a permutation surface 22 on the latch 20 of that particular lock 10. When the key 16 is inserted into the keyway 14, the bits 18 engage, and thus displace, the intermediary operators 30 in a predetermined sequence. During insertion of the key 16, the intermediary operators selectively engage the permutation surface 22 of the latch 20 to incrementally move the latch 20 from a first, locked position to a second, unlocked position.

The housing 12 may be monolithic or may be fabricated from two or more individual portions. The housing 12 may be fabricated from metal, and the entire housing 12 or portions thereof may be fabricated from hardened metals or other reinforced materials. A keyway 14 extends at least part way through the housing along a keyway axis 14*a*. The keyway 14 is shaped so that the key 16 is slidably receivable therein. Accordingly, the keyway 14 may have a cross-sectional shape which matches the cross-sectional shape of the key 16 with respect to a plane perpendicular to the keyway axis 14*a*. A cavity 26 may be formed within the housing 12 so that the latch 20 may be disposed within the housing 12, as will be discussed further herein. It should be recognized, however, that the cavity 26 need not be provided in the housing 12 if the latch 20 is situated other than within the housing 12, for example, on an exterior surface of the housing 12.

Figure 2A:
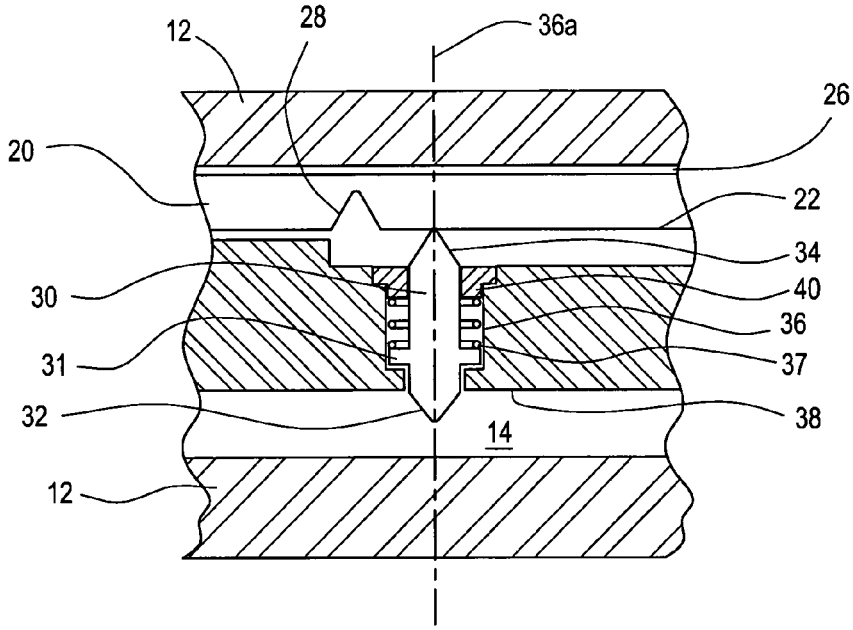
FIGS. 2A-2C are detail views of an intermediary operator according to the first embodiment of the present invention.
Figure 2B:
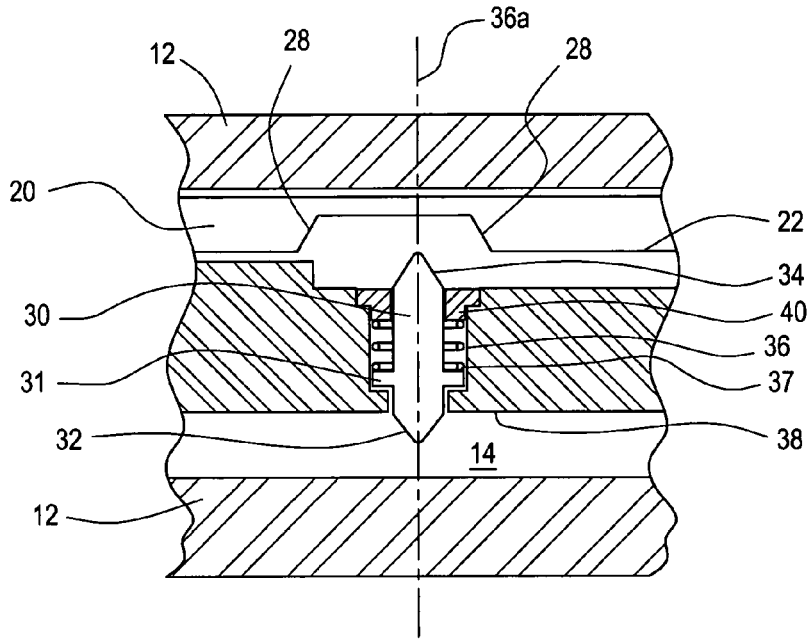
Figure 2C:
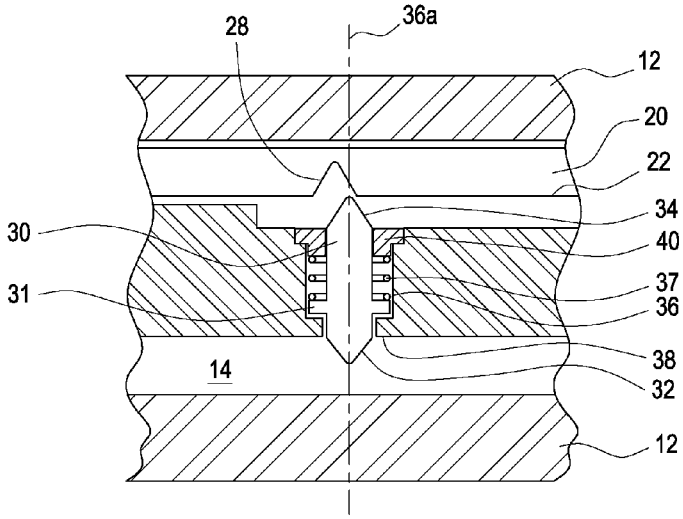

Within the housing 12, operating clearance for the plurality of intermediary operators 30 is provided by a plurality of bores 36 that are formed in the housing and are in communication with the keyway 14. The plurality of bores 36 are spaced from one another, and each bore extends from the keyway 14 toward the cavity 26 along a bore axis 36*a* (FIGS. 2A-2C). The bores 36 meet the cavity 26 adjacent to the permutation surface 22 of the latch 20.

The latch 20 is operatively connected to the housing 12 for movement with respect to the housing 12. In the present embodiment of the lock 10, the latch 20 is disposed within the cavity 26, in which the latch 20 may move with respect to the housing 12 by sliding along a latch axis 20*a*, which is substantially parallel to the keyway axis 14*a*. Particularly, the latch 20 slides between the first position, wherein the lock 10 is secured, and the second position, wherein the lock 10 is not secured. The latch 20 may be supported in the cavity 26 by bearings (not shown) that facilitate movement of the latch 20 between the locked and unlocked positions. A biasing element 24 may be disposed within the housing 12 in engagement with the latch 20 for biasing the latch 20 toward the first position. The biasing element 24 may be any conventionally known structure operative to exert a biasing force including, but not limited to, a spring or an elastic element. Although the present embodiment contemplates sliding translation of the latch 20 along a single axis, the present invention is not so limited. Rather, the latch 20 may be operatively connected to the housing 12 for linear or rotational translation, or a combination thereof, in one or more degrees of freedom.

The permutation surface 22 on the latch 20 is the portion of the lock 10 that corresponds to the key 16. That is to say, the latch 20 will only move from the locked position to the unlocked position in response to a specific sequence of motion of the intermediary operators 30, wherein the specific sequence of motion is dictated by the geometry of the permutation surface 22 provided on the latch 20 that is installed in the lock 10. Accordingly, across a population of locks 10, the specific geometric features of the permutation surface 22 of the locks 10 will differ. This is accomplished by providing a plurality of camming surfaces 28 on the permutation surface 22.

The camming surfaces 28 are geometric features that are cut, ground, stamped, cast or otherwise formed on the permutation surface 22 and which cause some manner of translation of the latch 20 in response to engagement by one or more of the intermediary operators 30. Specifically, motion of the intermediary operators 30 along a first line of action, such as the bore axis 36*a*, is operative to cause motion of the latch 20 along a second line of action, such as the latch axis 20*a*. While linear action of an intermediary operator 30 may be operative to cause rotational motion of the latch 20, in accordance with the most common conception of a cam, the camming surfaces 28 are not so limited. For example, the latch 20 may be constrained, by the geometry of the cavity 26 or otherwise, such that linear action of the intermediary operators 30, when engaging a camming surface 28 that extends at an arbitrary angle with respect to the line of action of the intermediary operator 30, causes motion of the latch 20 toward the unlocked position in a linear fashion, for example, along a line of action that is substantially perpendicular to the line of action of the intermediary operators 30. By way of example, the camming surfaces 28 may be triangular notches in the latch 20, and each intermediary operator 30 may be shaped correspondingly, such that off-center engagement of the intermediary operator 30 with the camming surface 28 causes the latch 20 to slide with respect to the housing until the intermediary operator 30 and the camming surface 28 are aligned. However, it will be recognized from the foregoing that the camming surfaces 28 are not limited to any particular shape, but rather, the camming surfaces 28 may take various forms, such as notches, ridges, steps, undulations, or various other types of surfaces irregularities, so long as engagement of one of the intermediary operators 30 with one of the camming surfaces 28 is operative to displace the latch 20 in some manner.

The intermediary operators 30 are disposed within respective bores 36 in the housing 12 and are engageable with both the key 16 and the permutation surface 22 of the latch 20. In particular, a first intermediary operator 30*a*, a second intermediary operator 30*b*, a third intermediary operator 30*c*, a fourth intermediary operator 30*d*, and a fifth intermediary operator 30*e* are each slidable with respect to the housing 12 over a limited range of motion for selective engagement with the latch 20 in response to engagement of a bit 18 of the key 16. However, it should be noted that the lock 10 is not limited to five intermediary operators 30, but rather may be provided with any number of intermediary operators 30 as desired.

As best shown in FIGS. 2A-2C, the intermediary operators 30 are substantially cylindrical members having tapered ends. At one end of each intermediary operator 30, a first portion 32 may extend at least partially into the keyway 14 for selective engagement with a bit 18 of the key 16. At the opposite end of each intermediary operator 30, a second portion 34 of each intermediary operator 30 may extend into the cavity 26 for selective engagement with one of the camming surfaces 28 on the permutation surface 22 of the latch 20. To allow selective engagement of the intermediary operators 30 with the key 16 and the latch 20, the intermediary operators 30 are slidably disposed within the plurality of bores 36 in the housing 12. Thus, each intermediary operator 30 may slide along a respective bore 36 between the keyway 14 and the cavity 26. In order to retain each intermediary operator 30 at least partially within a respective bore 36, at least one projection 31 may be formed on each intermediary operator 30. At the end of the bore 36 adjacent to the keyway 14, a shoulder 38 is formed in the housing for engagement with the projection 31. Opposite the shoulder 38, a bushing 40 is engageable with the projection 31.

By capturing the projection 31 of each intermediary operator 30 between the shoulder 38 and the bushing 40, a limited range of motion is established for each of the intermediary operators 30. Accordingly, the intermediary operators 30 may each move independently between a first, fully disengaged position, wherein the first portion 32 of the intermediary operator 30 is not engaged by a bit 18 of the key 16, and second, fully engaged position, wherein a bit 18 of the key 16 engages the first portion 32 of the intermediary operator 30. The fully disengaged position is reached when the projection 31 abuts the shoulder 38 (or other fixed restraint upon its motion toward the keyway 14), and the first portion 32 of the intermediary operator extends at least partially into the keyway 14. The fully engaged position occurs when the second portion 34 of the intermediary operator 30 is in abutment with the latch 20. Accordingly, the extent of displacement of the intermediary operator 30 when it reaches the fully engaged position is variable, being dependent upon the geometry and position of the latch 20 relative to the intermediary operator 30 in question, and thus represents the maximum displacement possible for that particular intermediary operator 30 at any particular instant. It follows that the intermediary operators 30 may further be disposed in a partially engaged position, between the fully engaged and fully disengaged positions, in response to engagement of a bit 18 of the key 16 with the first portion 32 of the intermediary operator 30. Optionally, a biasing element 37 may be provided for each intermediary operator 30 to bias the intermediary operators 30 toward the fully disengaged position, and thus toward the keyway 14.

Although the intermediary operators 30 are moveable with respect to the housing 12 between the fully disengaged position and the fully engaged position, the relative positions of the latch 20 and the intermediary operator 30 in question will dictate the result obtained by an attempt to displace the intermediary operator 30. In particular, one of three possible results may be obtained when one of the plurality of intermediary operators 30 is engaged by one of the bits 18 of the key 16: denial of displacement of the intermediary operator 30; displacement of the intermediary operator 30 that does not result in displacement of the latch 20; and finally, displacement of the intermediary operator 30 that results in displacement of the latch 20.

The first possible result of engagement of one of the bits 18 of the key 16 with one of the intermediary operators 30 is that displacement of the intermediary operator 30 is denied, as shown in FIG. 2A. This will occur, for example, when the geometry of the permutation surface 22 does not provide the necessary operating clearance adjacent to the bore 36 for the intermediary operator 30 to move toward the engaged position. That is to say that the second portion 34 of the intermediary operator 30 engages the permutation surface 22 while in the disengaged position, and further that the second portion 34 of the intermediary operator 30 does not engage a camming surface 28 on the permutation surface 22, and thus, no motion of the latch 20 results from the engagement of the intermediary operator 30 and the latch 20. For example, if the portion of the permutation surface 22 of the latch 20 that is adjacent to the intermediary operator 30 forms a plane that is substantially perpendicular to the line of action of the intermediary operator 30, displacement of the latch 20 will not result from engagement of the intermediary operator 30 with the permutation surface 22.

A further consequence of denial of displacement of one or more of the intermediary operators 30 may be that further insertion of the key 16 into the keyway is blocked by the presence of the intermediary operator 30 in the keyway. In this manner, access through the keyway 14 to the inner operators of the plurality of intermediary operators 30, for example, the fourth intermediary operator 30*d* and the fifth intermediary operator 30*e*, may be completely blocked until one or more of the outer operators of the plurality of intermediary operators, for example, the first intermediary operator 30*a*, the second intermediary operator 30*b*, and the third intermediary operator 30*c*, are selectively engaged and disengaged in the proper sequence.

The second possible result of engagement of one of the bits 18 of the key 16 with one of the intermediary operators 30 is that the intermediary operator 30 is displaced, but that the movement of the intermediary operator 30 from the disengaged position toward the engaged position does not result in displacement of the latch 20, as shown in FIG. 2B. In this case, the geometry of the permutation surface 22 of the latch 20 adjacent to the bore 36 provides appropriate operating clearance for the intermediary operator 30 to move from the disengaged position to the engaged position. However, there are no camming surfaces 28 in the path of the second portion 34 of the intermediary operator 30. Thus, since the intermediary operator 30 does not engage a camming surface 28, no motion is imparted to the latch 20. This might happen, for example, when the intermediary operator 30 is positioned between consecutive camming surfaces 28 of the latch 20. While movement of the intermediary operator 30 in this case does not produce motion of the latch 20, this type of motion could be caused by the key 16 as part of the correct operating sequence for the intermediary operators 30. By way of example, the permissive nature of this motion could be used to intentionally advance the key 16 in the keyway 14 without causing corresponding motion of the latch 20. Furthermore, while not capable of moving the latch 14, the presence of an intermediary operator 30 between two camming surfaces 28 can be employed to resist motion of the latch 20, for example, by restraining motion of the latch 20 toward the locked position in response to the force exerted upon the latch 20 by the biasing element 24.

The third possible result of engagement of one of the bits 18 of the key 16 with one of the intermediary operators 30 is that the intermediary operator 30 is displaced and causes movement of the latch 20, as shown in FIG. 2C. This will occur, for example, when one of the camming surfaces 28 on the permutation surface 22 is located along the line of action of the intermediary operator 30. Thus, when the second portion 34 of the intermediary operator 30 engages one of the camming surfaces 28, the displacement of the intermediary operator 30 causes translation of the latch 20 with respect to the housing 12.

In cases where displacement of one of the intermediary operators 30 causes displacement of the latch 20, it should be noted that the latch does not necessarily move toward the unlocked position. Rather, displacement of the latch 20 by the intermediary operators 30 can move the latch 20 toward the unlocked position, or in an arbitrary direction that is other than toward the unlocked position.

From the foregoing, it will be recognized that engagement of the plurality of intermediary operators 30 with the plurality of camming surfaces 28 on the permutation surface 22 of the latch 20 may be used to move the latch 20 over a distance that is greater than the pitch of any individual camming surface 28. Thus, by operating the intermediary operator 30 in a predetermined sequence, the latch 20 may be moved from a first position, wherein the lock 10 is locked, to a second position, wherein the lock 10 is unlocked.

In use, the lock 10 of the first embodiment of the present invention may be incorporated into a locking mechanism (not shown) whereby the latch 20 serves as an end effector or is directly or indirectly related to an end effector, such that movement of the latch 20 between the locked and unlocked positions is operative to lock and unlock the locking mechanism. A user wishing to unlock the lock 10 first presents the appropriate key 16 to the keyway 14. As the user begins insertion of the key 16 into the keyway 14, the latch 20 is in the locked position. As the key 16 slides into the keyway 14 the bits 18 of the key 16 selectively engage the intermediary operators 30 in a predetermined sequence comprising of either selective engagement and disengagement, selective magnitude, vector, or duration of engagement, or a combination thereof. The intermediary operators, in turn, engage the latch 20 to both move the latch 20 toward the unlocked position and to restrain the latch 20 from sliding toward the locked position as a result of the force exerted upon the latch 20 by the biasing element 24. It should be noted that the motion of the key 16 will not necessarily move the latch 20 at the same velocity or even along a parallel line of action. Nonetheless, movement of the latch 20 from the unlocked position to the locked position will occur in some rudimentary relation to the movement of the key 16 to the point where the blade of the key 16 is fully disposed within the keyway 14. Once the user has completed insertion of the key 16 into the keyway 14, the latch 20 of the lock 10 is in the unlocked position, and the locking mechanism may thus be operated. In the event that a key that does not correspond to the lock 10 is inserted into the keyway 14, insertion of the key may be blocked by the intermediary operators 30, or may be allowed, but will not cause the latch 20 to move to the unlocked position.

Figure 3:
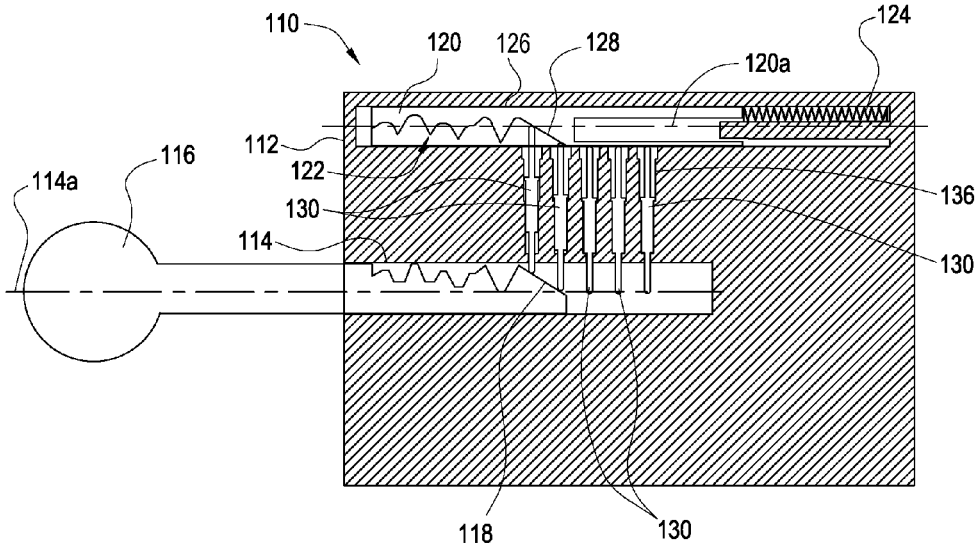
FIG. 3 is a sectional view of a second embodiment of the present invention.
Figure 4:
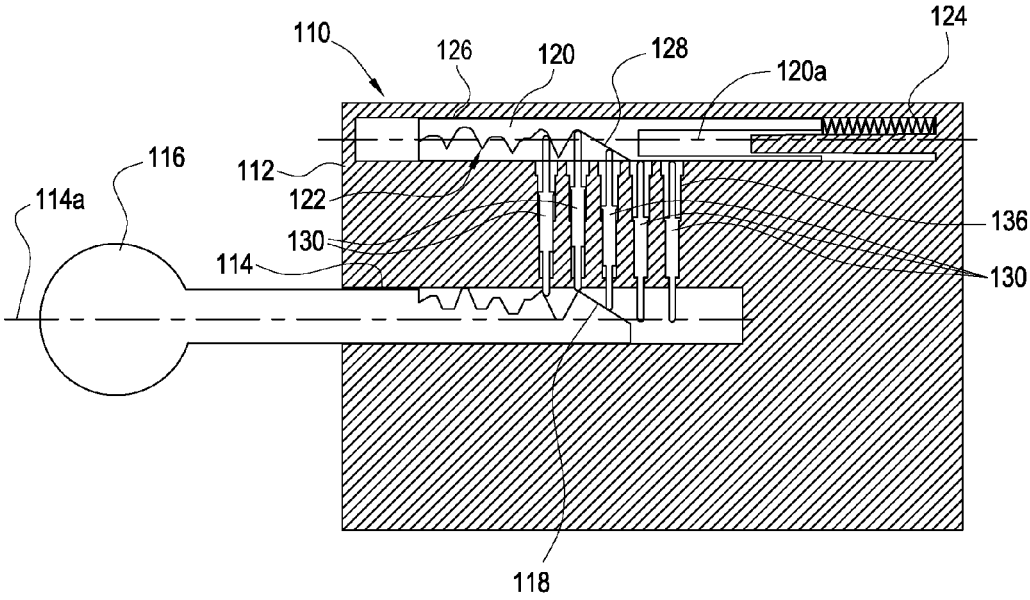
FIG. 4 is a sectional view of the second embodiment of the present invention.

Turning now to FIGS. 3-4, it will be seen that a key-operated mechanical lock 110 according to a second embodiment of the present invention includes a housing 112, a latch 120, and a plurality of intermediary operators 130. In similar manner to that discussed in connection with the lock 10 of the first embodiment, a keyway 114 is formed in the housing 112 along a keyway axis 114*a*, and a key 116 having bits 118 formed on at least one surface thereof is provided for operation of the lock 110.

The latch 120 is disposed within a cavity 126 within the housing 112 and is slidable along a latch axis 120*a* between a first, locked position and a second, unlocked position as discussed in connection with the first embodiment. A permutation surface 122 formed on the latch 120 includes a plurality of camming surfaces 128. The camming surfaces 128 are not uniform with respect to one another, but rather, differ in length, depth, and slope. However, the operating principle of the lock 10 applies similarly to the lock 110, and thus the bits 118 of the key are formed according to the geometry of the camming surfaces 128. Thus, as seen by comparison of FIGS. 3-4, which show the lock 110 at different points during insertion of the key 116 into the keyway 114, each operator of the plurality of intermediary operators selectively engages and disengages the camming surfaces 128 of the latch 120 in response to engagement of the key 116 with the intermediary operators 130 as it enters the keyway 114. Specifically, each intermediary operator 130 must move in alternating fashion toward the fully engaged and disengaged positions in a predetermined sequence according to the geometry of the camming surfaces 128 in order to move the latch 120 to the unlocked position in opposition to the force of the biasing element 124.

Use of the lock 110 of the second embodiment is accomplished in substantially the same manner as described in connection with the lock 10 of the first embodiment.

Figure 5:
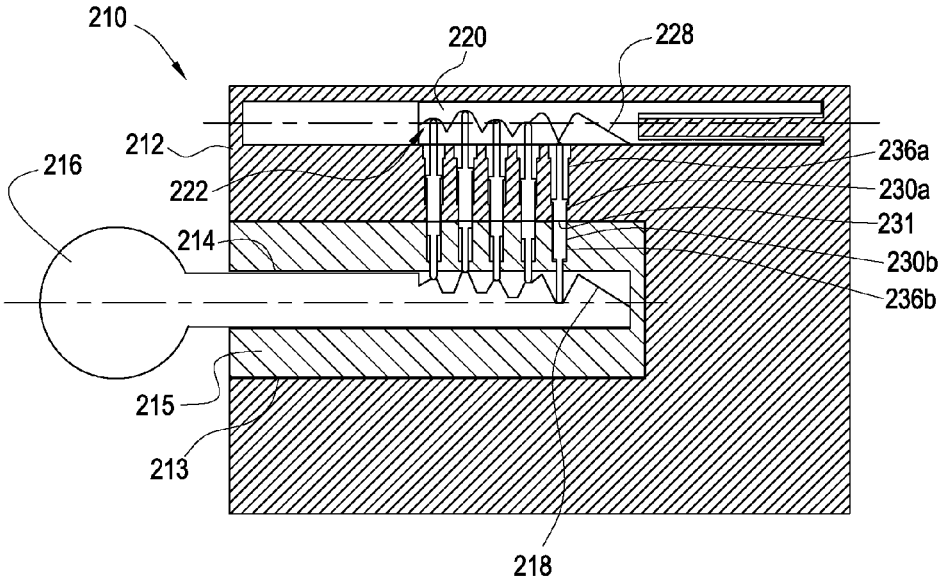
FIG. 5 is a sectional view of a third embodiment of the present invention.

Turning now to FIG. 5, it will be seen that a key-operated mechanical lock 210 according to a third embodiment of the present invention is similar in many respects to the lock 110 of the second embodiment, and includes a housing 212, and a latch 220 having a permutation surface 222 with a plurality of camming surfaces 228 formed thereon.

A chamber 213 is formed in the housing 212, and a cylindrical plug 215 is rotatably disposed within the chamber 213. A plurality of split pins having upper pin portions 230*a* and lower pin portions 230*b* serve as intermediary operators, and are disposed in bores having upper bore portions 236*a* formed in the housing 212 and lower bore portions 236*b* formed in the cylindrical plug 215. In this manner, interfaces 231 are formed between each of the upper and lower pin portions 230*a*, 230*b*. When at least one of the interfaces 231 is not aligned at the shear line formed where the cylindrical plug 215 abuts the housing 212, the cylindrical plug 215 is restrained against rotation with respect to the housing 212. When the interfaces 231 are all located at the shear line, the cylindrical plug 215 may rotate with respect to the housing 212. Accordingly, the locations of the interfaces 231 may be selected so that they are disposed at the shear line only when the key 216 is fully inserted into the keyway 214, and the latch 220 is thus in the unlocked position.

Use of the lock 210 of the third embodiment is accomplished in similar manner as described in connection with the lock 10 of the first embodiment and the lock 110 of the second embodiment. However, once the key 216 is fully inserted into the keyway 214, the user turns the key 216, thereby rotating the cylindrical plug 215, which is connected to a rotation-responsive end-effector (not shown).

Figure 6:
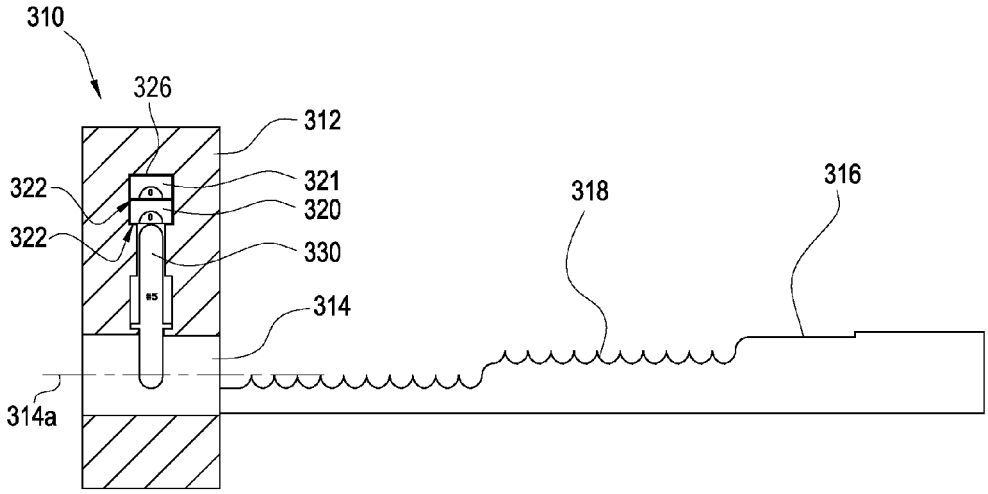
FIG. 6 is a sectional view of a fourth embodiment of the present invention.

As shown in FIG. 6, a key-operated mechanical lock 310 according to a fourth embodiment of the present invention includes a housing 312 having a keyway 314, a chamber 326, and a plurality of bores 336 formed therein. The keyway 314 extends along a keyway axis 314*a*. A first latch 320 and a second latch 321 are slidably disposed within the chamber 326, each having a permutation surface 322 with a plurality of camming surfaces 328 formed thereon, as discussed previously. A plurality of intermediary operators 330 are each disposed in a respective bore of the plurality of bores 336. The plurality of bores 336 are spaced with respect to one another along a line that extends transverse to the keyway axis 314*a*.

Figure 7:
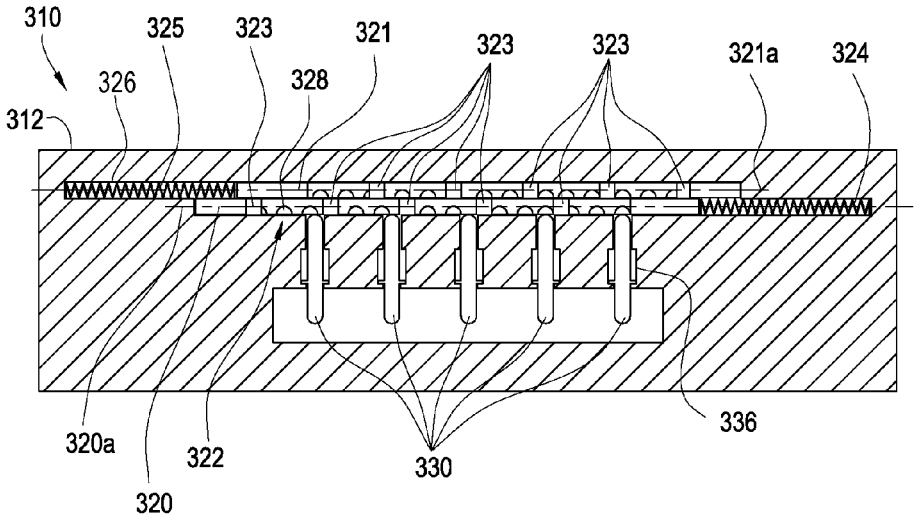
FIG. 7 is a sectional view of the fourth embodiment of the present invention.

The first latch 320 and the second latch 321 are disposed within the chamber 326 in a stacked formation, such that the first latch lies adjacent to the bores 336 and thus closer to the keyway 314 than the second latch 321. As best seen in FIG. 7, the first latch 320 and the second latch 321 move along a first latch axis 320*a* and a second latch axis 321*a*, respectively, which are substantially perpendicular to the keyway axis 314*a*. Particularly, the first latch 320 slides along the first latch axis 320*a* between a first, locked position, and a second, unlocked position, while the second latch 321 slides along the second latch axis 321*a* between a first, locked position, and a second, unlocked position. The first latch 320 and the second latch 321 are each biased toward the locked position by a biasing element 324.

A plurality of apertures 323 are formed in each of the first latch 320 and the second latch 321. When the first latch reaches the second, unlocked position, the apertures 323 on the first latch 320 move into alignment with the intermediary operators 330. Thus, once the first latch 320 reaches the unlocked position, the intermediary operators 330 pass through the apertures 323 to allow engagement of the intermediary operators 330 with the camming surfaces 328 on the second latch 321. Similarly, the apertures 323 on the second latch 321 move into alignment with the intermediary operators 330 when the second latch reaches the second, unlocked position, allowing the intermediary operators to move into the apertures 323 to thereby retain the second latch 321 in the unlocked position.

Figure 8:
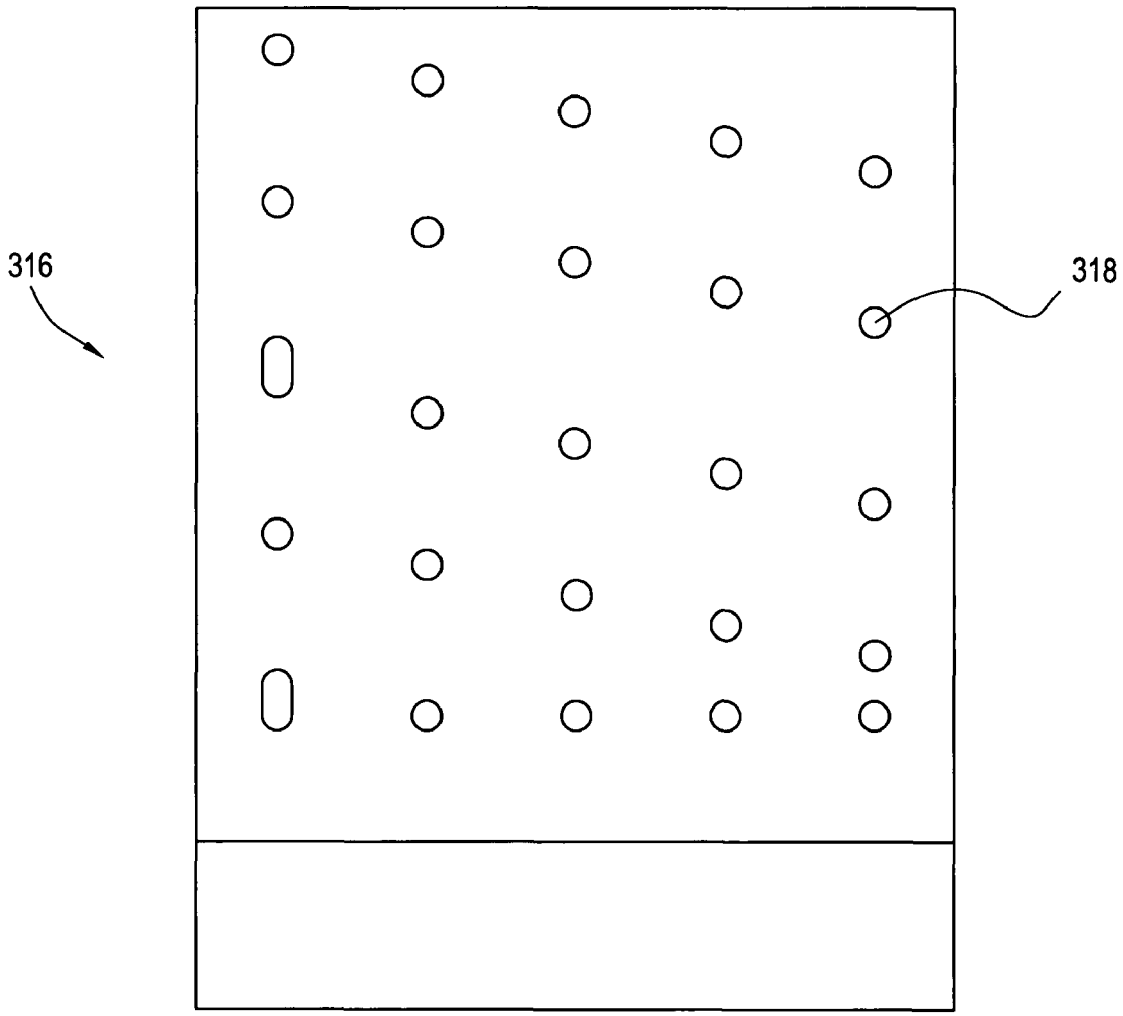
FIG. 8 is a top view of a key according to the fourth embodiment of the present invention.

As best shown in FIG. 8, the lock 310 is operated by a key 316 having a plurality of bits 318 formed on an upper surface thereof. The key 316 is substantially planar, and the bits 318 are formed on the upper surface of the key 316 as projections or bumps, arrayed with respect to both the width and length of the key 316. The bits 318 may vary with respect to one another in length, height, width and profile.

In use, the lock 310 of the fourth embodiment is used in similar fashion to that of the locks in the previously discussed embodiments. However, as the user slides the key 316 into the keyway 314, the first latch 320 is initially engaged by the intermediary operators 330 in a predetermined sequence, thereby moving the first latch 320 along the first latch axis 320*a* until the first latch 320 reaches the unlocked position. Once the first latch 320 reaches the unlocked position, the intermediary operators 330 may pass through the apertures 323 and thus engage the second latch 321. As the user continues insertion of the key 316 into the keyway 314, the intermediary operators 330 engage the second latch 321 in a predetermined sequence, thus moving the second latch 321 along the second latch axis 321*a* until the second latch 321 reaches the unlocked position, thereby unlocking the lock 310.

Figure 9:
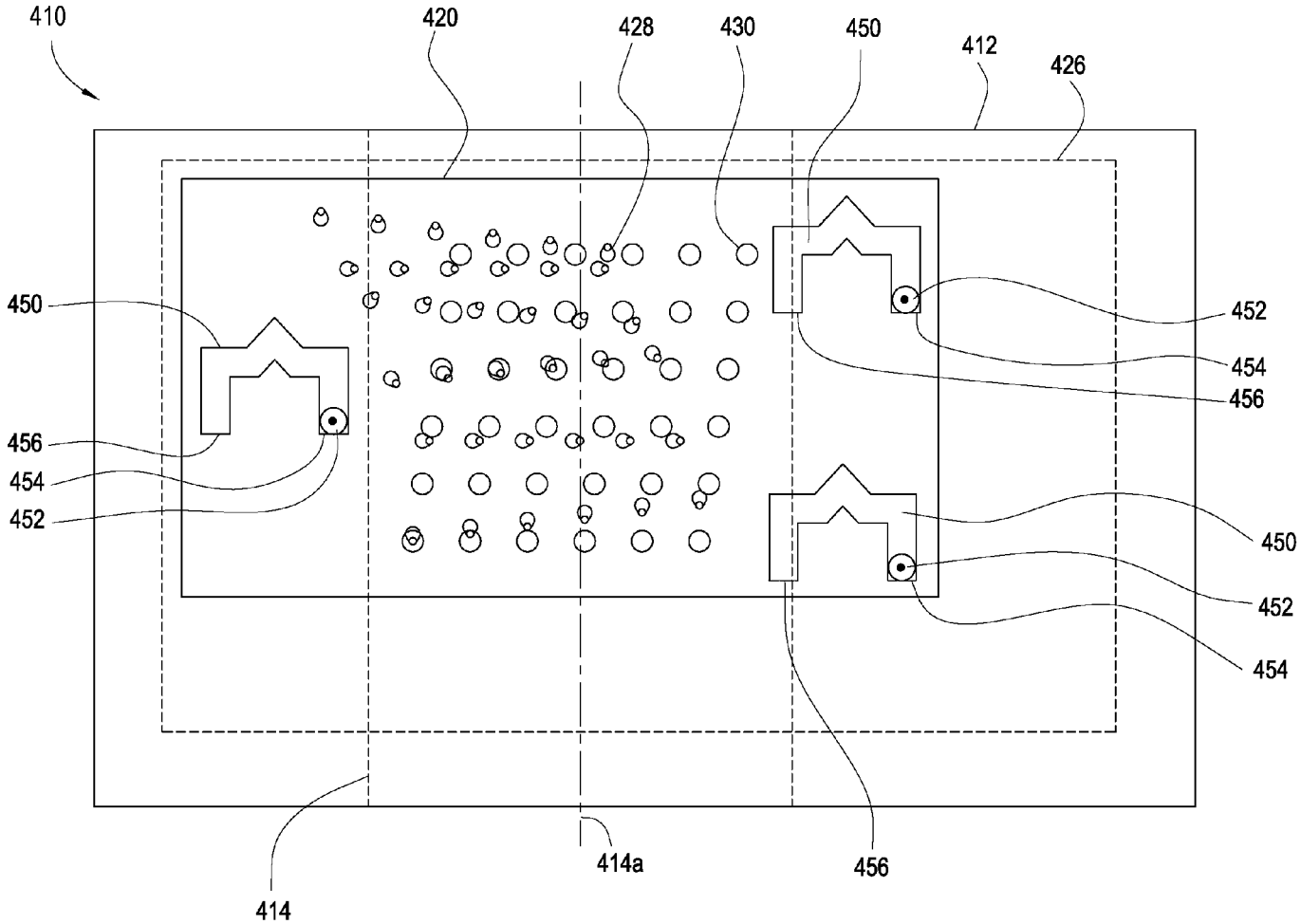
FIG. 9 is a sectional view of a fifth embodiment of the present invention.
Figure 10:
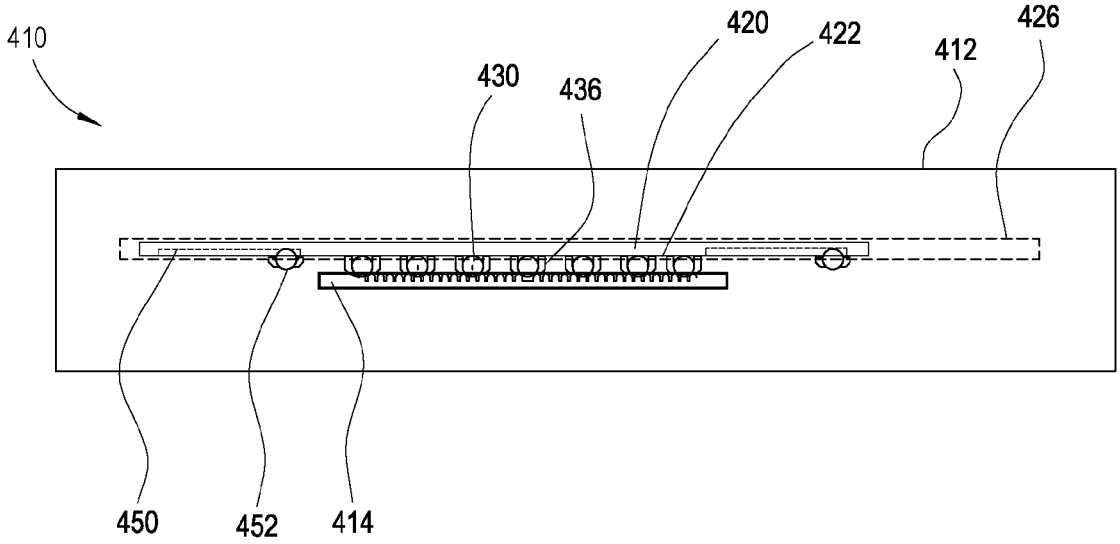
FIG. 10 is a sectional view of the fifth embodiment of the present invention.

According to a fifth embodiment of the present invention, as seen in FIGS. 9-10, a key-operated mechanical lock 410 includes a housing 412, a latch 420 having a permutation surface 422 formed thereon, and a plurality of intermediary operators 430. The latch is moveable between a first, locked position, and a second, unlocked position.

A keyway 414, a chamber 426, and a plurality of bores 436 are formed in the housing 412. They keyway 414 is substantially planar, having a squashed rectangular cross-section that extends along a keyway axis 414*a*. The chamber 426 is spaced from the keyway 414 by the bores 436, and the bores 436 are in communication with both the keyway 414 and the chamber 426. The chamber 426 is sized to allow movement of the latch 420 therein, as will be discussed herein. The bores 436 may be spaced across the width of the keyway 414, or may be arrayed with respect to both the width and length of the keyway 414.

Figure 11:
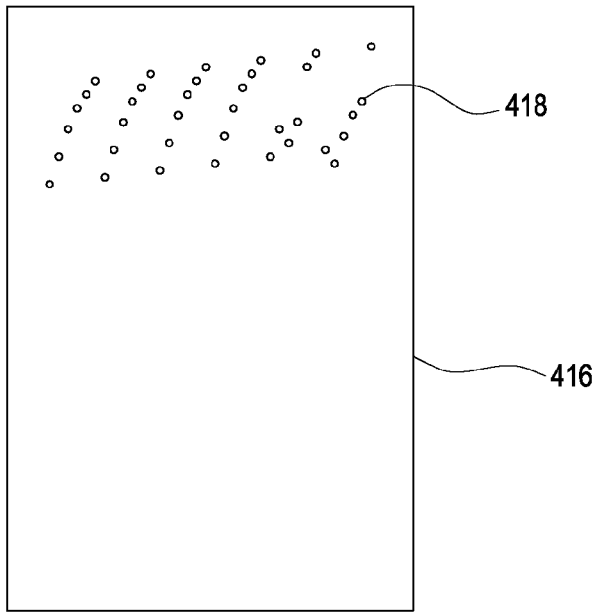
FIG. 11 is a top view of a key according to the fifth embodiment of the present invention.
Figure 12:
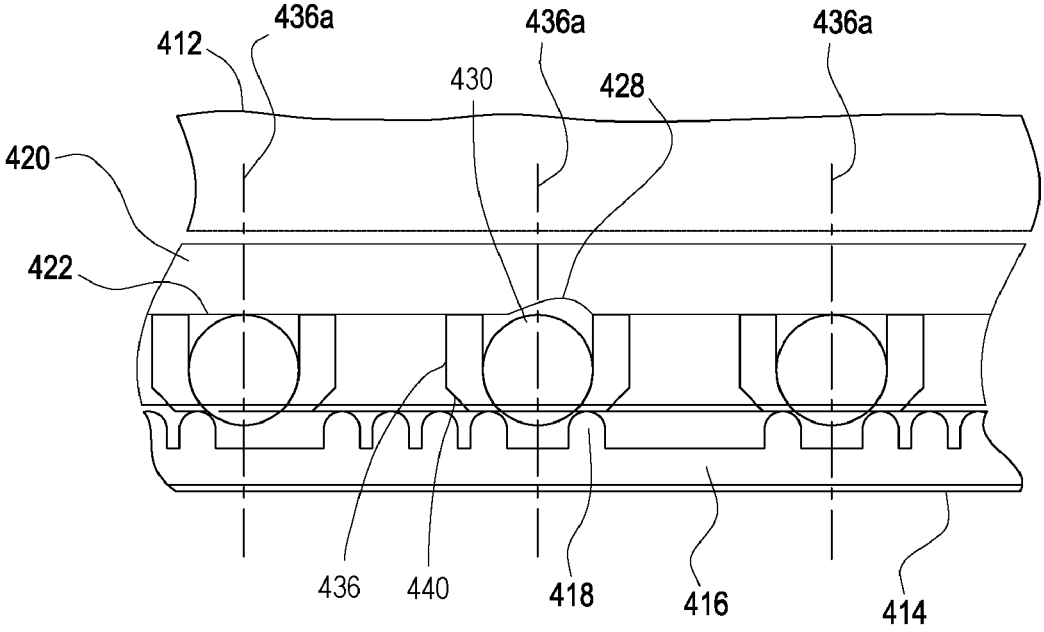
FIG. 12 is a detail view of the fifth embodiment of the present invention.

The lock 410 is operated by a key 416 that is substantially planar, and sized for insertion into the keyway 414. A plurality of bits 418 are formed on an upper surface of the key 416, as seen in FIGS. 11-12. The bits 418 may be formed in numerous ways, as discussed in connection with the fourth embodiment, and are arrayed with respect to both the width and length of the key 416.

The plurality of intermediary operators 430 are each disposed within a respective bore of the plurality of bores 436. Furthermore, a bushing 440 may be disposed in each bore 436 adjacent to the keyway 414 so that the intermediary operators 430 are retained in the bores 436 between the bushings 440 and the latch 420. Accordingly, each of the intermediary operators 430 may move along a bore axis 436*a* between a fully disengaged position, wherein the intermediary operator 430 extends at least partially into the keyway 414 and abuts the bushing 440, and a fully engaged position, wherein the intermediary operator extends at least partially into the chamber 426 for engagement with the permutation surface of the latch 420.

The latch 420 is disposed within the chamber 426 for movement in two degrees of freedom within a plane that is substantially parallel to the keyway 414. Bearings (not shown) may be provided to support the latch 420 with respect to the chamber 426. In order to restrain the latch 420 to a range of permissible movements, one or more guide channels 450 are formed through the latch 420, and a guide post 452 extends through each guide channel 450, wherein engagement of the guide posts 452 with the edges of the guide channel 450 restrains motion of the latch 420. The guide channels 450 may be formed with any number of curved or linear segments that extend at angles with respect to one another to limit the path of travel of the latch 420 as it moves between the locked and unlocked positions. The guide channels 450 extend from a first end 454 to a second end 456, wherein each guide post 452 is adjacent to the first end 454 of a respective guide channel 450 when the latch 420 is in the locked position, and each guide post 452 is adjacent to the second end 456 of a respective guide channel 450 when the latch 420 is in the unlocked position.

Figure 13:
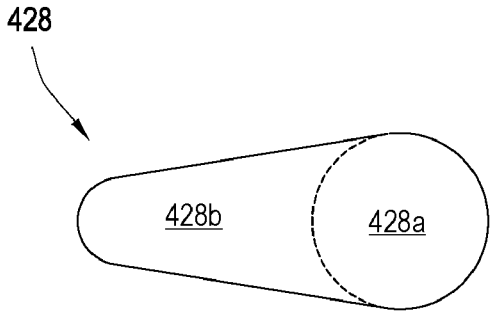
FIG. 13 is top, detail view of a camming surface according to the fifth embodiment of the present invention.
Figure 14:
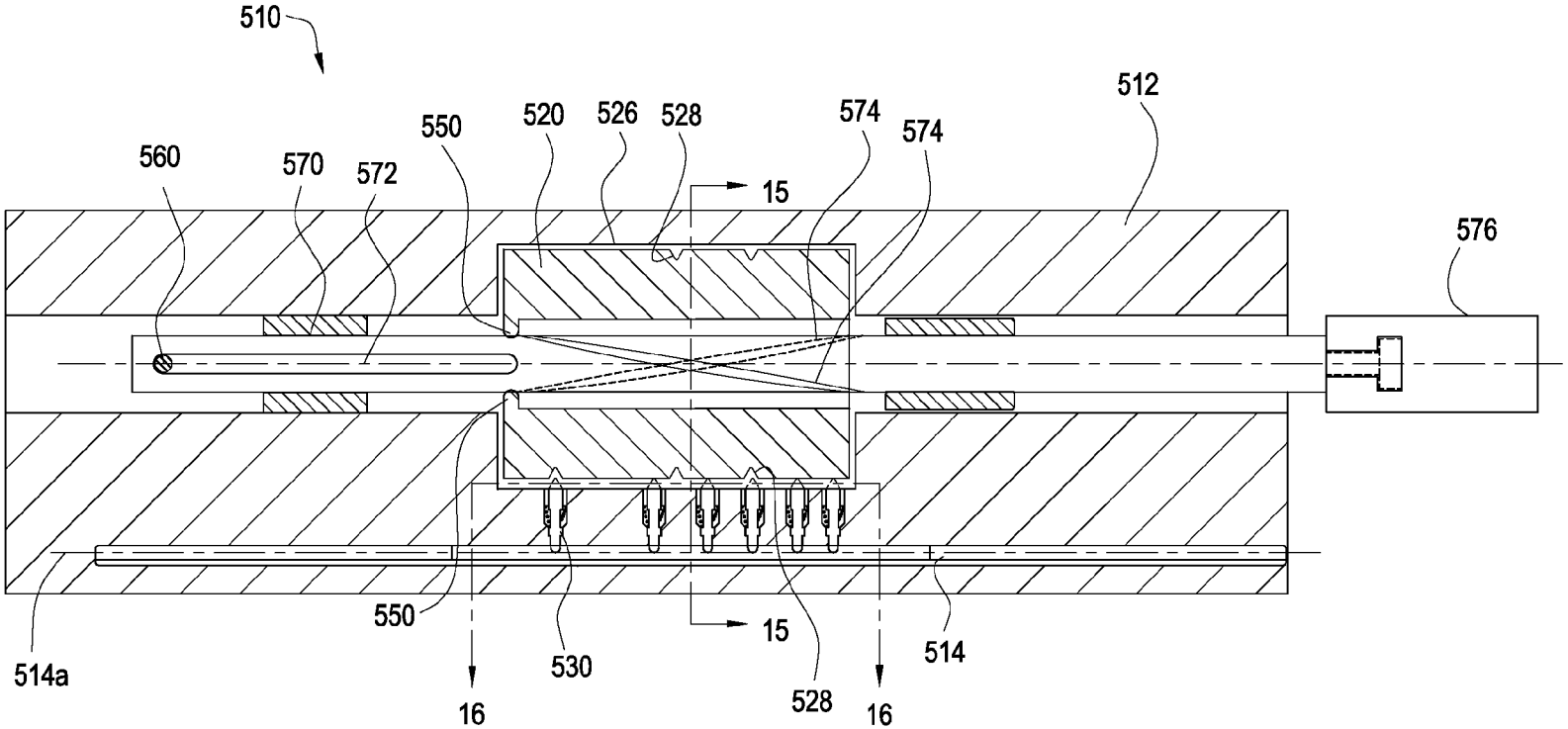
FIG. 14 is a sectional of a sixth embodiment of the present invention.

In order to move the latch 420 between the locked and unlocked positions, the plurality of camming surfaces 428 are formed on the permutation surface 422 of the latch 420, as best seen in FIG. 13. Accordingly, when one of the intermediary operators 430 is aligned with one of the camming surfaces 428 in an off center fashion, movement of that intermediary operator 430 toward the fully engaged position causes the latch 420 to shift with respect to the housing 412. In particular, as shown in FIG. 13, each camming surface 428 includes a recess portion 428*a*, shaped complementarily to the intermediary operators 430, and a ramp surface 428*b*, which extends outward from the recess portion 428*a* at a more gradual angle, and thus defines the vector along which movement of the latch 420 will proceed when one of the intermediary operators 430 engages the camming surface 428 at the outer extent of the ramp surface 428*b*. It should further be appreciated that one of the intermediary operators 430 were moved to the fully engaged position while perfectly aligned with the recess portion 428*a* of one of the camming surfaces 428, no motion would be imparted to the latch 420.

In accordance with the foregoing discussion, it will be appreciated that camming surfaces 428 are formed on the permutation surface 422 of the latch 420 in appropriate locations and orientations to cause the latch 420 to move according to the constraints placed upon it by the guide channels 450 in response to the corresponding key 416. However, it should also be appreciated that additional camming surfaces 428 could be formed on the latch 420 to produce erroneous movement of the latch 420 in response to erroneous actuation of the intermediary operators, for example, by an improper key. It will further be appreciated that an additional set of camming surfaces 428 could be placed on the latch 420 to allow movement of the latch 420 from the locked position to the unlocked position in response to a different predetermined sequence of actuation of the intermediary operators 430, to allow for master keying.

Use of the lock 410 of the fifth embodiment is accomplished in similar manner as discussed in connection with the first through fourth embodiments. As user inserts the key 416 into the keyway 414, selective engagement of the bits 418 of the key 416 with the intermediary operators 430 causes the intermediary operators 430 to engage the camming surfaces 428 of the latch 420. As the latch 420 moves incrementally in response to engagement by the intermediary operators 430 in the predetermined sequence dictated by the arrangement of the camming surfaces 428 on the latch, the guide posts 452 move through the guide channels 450 from the first end 454 and the second end 456 thereof. When the latch 420 reaches the unlocked position, an operatively associated end effector is actuated.

According to a sixth embodiment of the present invention, as seen in FIGS. 14-17, a key-operated mechanical lock 510 includes a housing 512, a latch 520 having a permutation surface 522 formed thereon, a plurality of intermediary operators 530, a slider 570 and a bolt 576. The latch 520 is moveable between a first, locked position, and a second, unlocked position.

Figure 17:
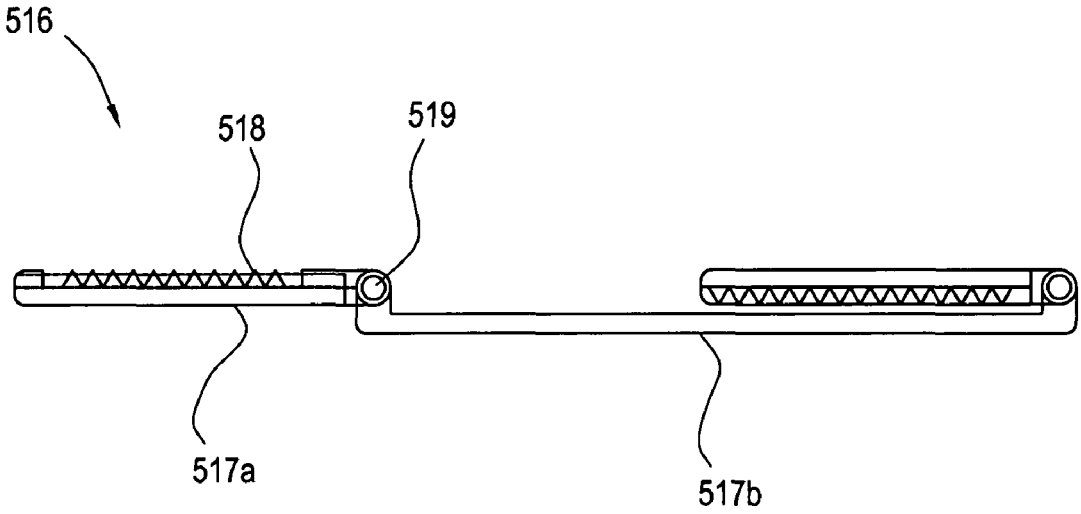
FIG. 17 is a side view of a key according to the sixth embodiment of the present invention.

A keyway 514, a chamber 526, and a plurality of bores 536 are formed in the housing 512. The keyway 514 extends along a keyway axis 514*a*, and is shaped to receive a hinged key 516, as best shown in FIG. 17. The hinged key 516 includes a bit portion 517*a* connected to a handle portion 517*b* by a hinge 519. A plurality of bits 518 are formed on the bit portion 517*a*. The bits 518 may be formed in numerous ways, as discussed in connection with the previous embodiments, and are arrayed with respect to both the width and length of the key 516.

Figure 16:
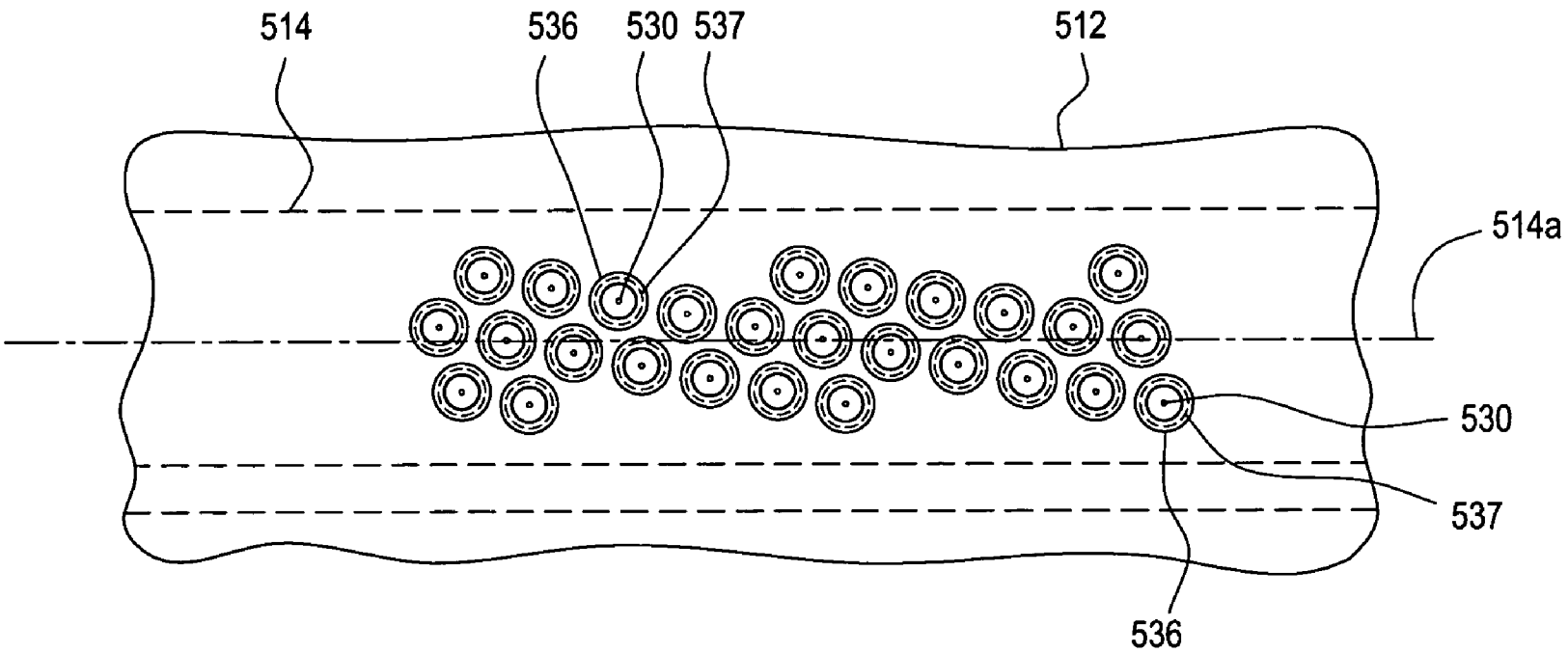
FIG. 16 is a sectional view of the sixth embodiment of the present invention.

The chamber 526 is spaced from the keyway 514 by the bores 536, and the bores 536 are in communication with both the keyway 514 and the chamber 526. The chamber 526 is sized to allow movement of the latch 520 therein, as will be discussed herein. As best shown in FIG. 16, the bores 536 may be spaced across the width of the keyway 514, or may be arrayed with respect to both the width and length of the keyway 514. At the end of each bore 536 adjacent to the keyway 514, a shoulder 538 is formed in the housing for engagement with a projection 531 formed on each intermediary operator 530, to retain the intermediary operator 530 within its respective bore 536.

The plurality of intermediary operators 530 are each disposed within a respective bore of the plurality of bores 536. At one end of each intermediary operator 530, a first portion 532 may extend at least partially into the keyway 514 for selective engagement with a bit 518 of the key 516. At the opposite end of each intermediary operator 530, a second portion 534 of each intermediary operator 530 may extend into the chamber 526 for selective engagement with one of the camming surfaces 528 on the permutation surface 522 of the latch 520. A bushing 540 may be disposed in each bore 536 adjacent to the keyway 514 so that the intermediary operators 530 are retained in the bores 536. A spring 537 is provided in each bore between the bushing 540 and the projection 531 on the intermediary operator 530 in order to bias the intermediary operator 530 toward the keyway 514. Accordingly, each of the intermediary operators 530 may move along a bore axis 536*a* between a fully disengaged position, wherein the intermediary operator 530 extends at least partially into the keyway 514, and a fully engaged position, wherein the intermediary operator extends at least partially into the chamber 526 for engagement with the permutation surface 522 of the latch 520.

The latch 520 is substantially cylindrical, hollow, and is disposed within the chamber 526 for rotation about an axis that extends longitudinally through the latch 520. Bearings (not shown) may be provided to support the latch 520 with respect to the chamber 526. In order to impart motion to the slider 570, a pair of fingers 550 extend radially inward from the latch 520. The latch 520 is restrained against translation with respect to the housing 512, but may rotate within the chamber 526. In this manner, engagement of the fingers 550 with the slider 570 during rotation of the latch 520 causes the slider 570 to move linearly along the axis of rotation of the latch 520 between the locked and unlocked positions, as will be described in detail herein.

Figure 15:
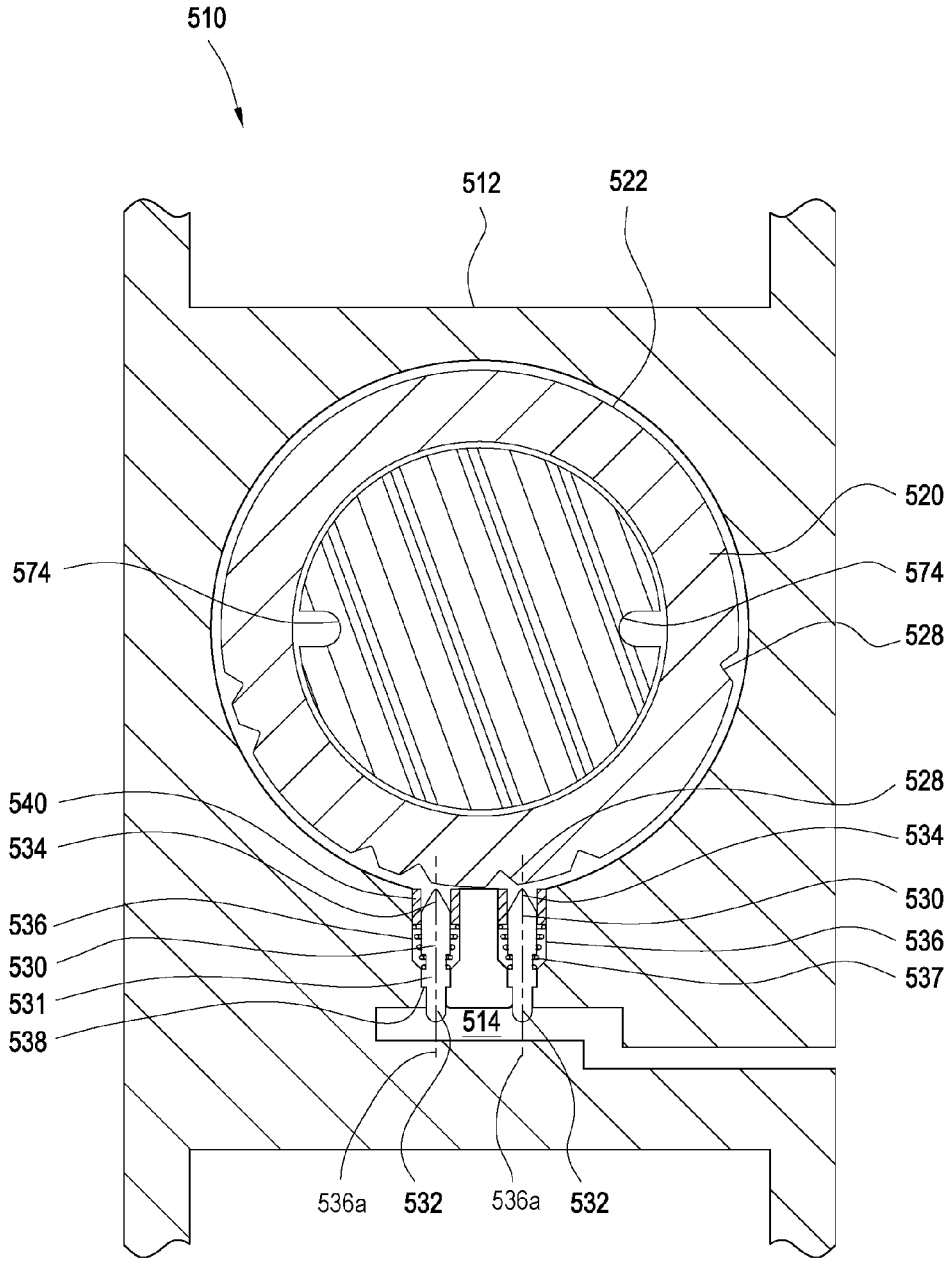
FIG. 15 is a sectional view of the sixth embodiment of the present invention.

In order to move the latch 520 between the locked and unlocked positions, the plurality of camming surfaces 528 are formed on the permutation surface 522 of the latch 520, as best seen in FIG. 15. Accordingly, when one of the intermediary operators 530 is aligned with one of the camming surfaces 528 in an off center fashion, movement of that intermediary operator 530 toward the fully engaged position causes the latch 520 to rotate with respect to the housing 512.

The slider 570 is disposed within the chamber 526 for linear movement with respect to the housing 512. Furthermore, a bolt 576 may be attached to one end of the slider 570 for use as an end effector, receivable within, for example, a corresponding aperture (not shown) in a door frame (not shown) as is well known in the art. Accordingly, movement of the latch 520 from the locked position to the unlocked position moves the slider 570 from a corresponding locked position to a corresponding unlocked position. The slider 570 is restrained against rotation with respect to the housing by a pin 560 that is connected to the housing 512, and is disposed within a slot 572 in the slider 570. The slot 572 extends transversely through the slider 570, and along the longitudinal axis of the slider. A pair of helical grooves 574 are formed in the slider 570 in the area near the latch 520, and the fingers 550 of the latch 520 extend into the helical grooves 574. Thus, when the latch 520 rotates in response to the intermediary operators 530, the fingers 550 engage the helical grooves 574 of the slider 570. Since the slider 570 is restrained against rotation by the pin 560, and the latch 520 is restrained against linear displacement by the housing 512, the rotational motion of the fingers 550 causes the slider 570 to move between the locked and unlocked positions.

Use of the lock 510 of the sixth embodiment is accomplished in similar manner as discussed in connection with the previous embodiments. As user inserts the key 516 into the keyway 514, selective engagement of the bits 518 of the key 516 with the intermediary operators 530 causes the intermediary operators 530 to engage the camming surfaces 528 of the latch 520. As the latch 520 rotates incrementally in response to engagement by the intermediary operators 530 in the predetermined sequence dictated by the arrangement of the camming surfaces 528 on the latch, the fingers 550 on the latch 520 engage the helical grooves 574, thereby causing linear motion of the slider 570. When the latch 520 reaches the unlocked position, an operatively associated end effector, namely the slider 570 and associated bolt 576 is likewise disposed in the unlocked position.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

What is claimed is:

1. A lock operated by a corresponding key, comprising:

a housing;

a keyway formed in said housing for receiving the corresponding key therein, wherein said keyway extends along a keyway axis;

a latch movable with respect to said housing between a first position, wherein the lock is secured, and a second position, wherein the lock is not secured;

a permutation surface formed on said latch, said permutation surface configured to correspond to said corresponding key; and a plurality of intermediaries disposed within said housing, said intermediaries moveable independent of one another, each intermediary having a first portion engageable with said permutation surface of said latch and a second portion engageable with the corresponding key, wherein engagement of the corresponding key with said intermediaries selectively engages said intermediaries with said permutation surface in a predetermined sequence, thereby moving said latch from said first position to said second position.

2. The lock stated in claim 1, wherein said latch translates linearly between said first position and said second position.

3. The lock stated in claim 1, wherein said latch rotates between said secured and unsecured positions.

4. The lock stated in claim 1, further comprising:

a plurality of camming surfaces formed on said permutation surface of said latch in correspondence with said corresponding key, wherein engagement of an intermediary of said plurality of intermediaries with a camming surface of said plurality of camming surfaces is operable to move said latch.

5. The lock stated in claim 1, further comprising:

a plurality of camming surfaces formed on said permutation surface of said latch, wherein engagement of an intermediary of said plurality of intermediaries with a camming surface of said plurality of camming surfaces is operable to rotate said latch with respect to said keyway axis.

6. The lock stated in claim 1, wherein said each intermediary of said plurality of intermediaries moves along a bore that is formed in said housing.

7. A lock operated by a corresponding key, comprising:

a housing;

a keyway formed in said housing for receiving the corresponding key therein, wherein said keyway extends along a keyway axis;

a plurality of bores formed in said housing, wherein each bore of said plurality of bores is in communication with said keyway and extends substantially perpendicular to said keyway axis;

a chamber formed in said housing and spaced from said keyway by said plurality of bores, wherein said chamber is in communication with each said bore of said plurality of bores;

a latch disposed within said chamber and movable with respect to said housing between a first position, wherein the lock is secured, and a second position, wherein the lock is not secured, the latch having a permutation surface with a plurality of camming surfaces formed thereon; and a plurality of intermediaries, each disposed within a respective bore of said plurality of bores, and each having a first portion engageable with said permutation surface of said latch and a second portion engageable with the corresponding key, wherein engagement of the corresponding key with said intermediaries selectively engages said intermediaries with said camming surfaces on said permutation surface in a predetermined sequence, thereby moving said latch from said first position to said second position.

8. The lock stated in claim 7, wherein said latch translates linearly between said first position and said second position.

9. The lock stated in claim 7, wherein said latch rotates between said locked and unlocked positions.

10. The lock stated in claim 7, wherein each intermediary of said plurality of intermediaries is substantially cylindrical.

11. The lock stated in claim 7, wherein each intermediary of said plurality of intermediaries is substantially spherical.

12. The lock stated in claim 7, wherein said plurality of intermediaries are arrayed at spaced locations along said keyway axis.

13. The lock stated in claim 7, wherein said plurality of intermediaries are arrayed across said keyway axis.

14. The lock stated in claim 7, wherein said each intermediary of said plurality of intermediaries moves along a first line of action, and said latch moves within a plane extending substantially perpendicular to said first line of action.

15. A lock for use with a key having a bit profile, the lock comprising:

a housing;

a keyway formed in the housing for receiving the key therein;

a latch moveable with respect to the housing between a first position and a second position, the latch having a permutation profile formed thereon; and a plurality of intermediaries each having a first portion that is disposed within the keyway for engagement with the key and a second portion that is disposed adjacent to the latch for engagement with the latch, wherein engagement of the intermediaries with the latch during sliding engagement of the key with the intermediaries is operable to move the latch from the first position to the second position if the bit profile of the key corresponds to the permutation profile of the latch.

16. The lock of claim 15, wherein the intermediaries move independently of one another.

17. The lock of claim 15, wherein a distance between the keyway and the second portion of each intermediary varies during insertion of the key into the keyway in direct correspondence to the bit profile of the key.

18. The lock of claim 15, wherein the intermediaries are each biased toward the keyway.

19. The lock of claim 15, further comprising:

a plurality of bores formed in the housing, wherein each intermediary is disposed within a corresponding bore of the plurality of bores.

20. The lock of claim 15, wherein each intermediary comprises a pin.

* * * * *